US008087533B2

(12) United States Patent
Sellers

(10) Patent No.: US 8,087,533 B2
(45) Date of Patent: Jan. 3, 2012

(54) SYSTEMS AND METHODS FOR PROVIDING A REMOVABLE SLIDING ACCESS DOOR FOR AN ICE STORAGE BIN

(75) Inventor: David Anglin Sellers, Newnan, GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 788 days.

(21) Appl. No.: 11/752,696

(22) Filed: May 23, 2007

(65) Prior Publication Data

US 2007/0273261 A1 Nov. 29, 2007

Related U.S. Application Data

(60) Provisional application No. 60/808,022, filed on May 24, 2006.

(51) Int. Cl.
*B65D 43/12* (2006.01)

(52) U.S. Cl. ..... 220/345.1

(58) Field of Classification Search ..... 220/254.9, 220/345.1, 345.2–345.5, 348–351
See application file for complete search history.

(56) References Cited

U.S. PATENT DOCUMENTS

| | | | | |
|---|---|---|---|---|
| 1,957,594 | A | | 5/1934 | Helm |
| 2,085,314 | A | | 6/1937 | Hamilton |
| 2,554,669 | A | | 5/1951 | Elofson |
| 2,842,175 | A | | 7/1958 | Thompson |
| 2,860,027 | A | | 11/1958 | Swanson et al. |
| 3,048,304 | A | | 8/1962 | Polzin |
| 3,165,240 | A | | 1/1965 | Maquelin |
| 3,276,224 | A | | 10/1966 | Lunde |
| 3,289,430 | A | | 12/1966 | Dedricks et al. |
| 3,430,452 | A | | 3/1969 | Dedricks et al. |
| 3,449,920 | A | | 6/1969 | Van Steenburgh, Jr. |
| 3,527,373 | A | * | 9/1970 | Giraudet et al. ..... 220/345.1 |
| 3,610,482 | A | | 10/1971 | Van Steenburgh, Jr. |
| 3,613,389 | A | | 10/1971 | Ohlsson et al. |
| 3,626,486 | A | | 12/1971 | Bugbee et al. |
| 3,918,617 | A | | 11/1975 | Gregg |
| 4,349,128 | A | | 9/1982 | Sanfilippo |
| 4,406,395 | A | | 9/1983 | Scoggins |
| 4,469,210 | A | | 9/1984 | Blumer et al. |
| 4,480,441 | A | | 11/1984 | Schulze-Berge et al. |
| 4,489,567 | A | | 12/1984 | Kohl |
| 4,498,607 | A | | 2/1985 | Jaschinski |
| 4,537,331 | A | | 8/1985 | Matula |
| 4,550,572 | A | | 11/1985 | Schulze-Berge |
| 4,562,941 | A | | 1/1986 | Sanfilippo |

(Continued)

FOREIGN PATENT DOCUMENTS

| | | |
|---|---|---|
| CA | 2538283 | 4/2005 |

(Continued)

*Primary Examiner* — Anthony Stashick
*Assistant Examiner* — James N Smalley
(74) *Attorney, Agent, or Firm* — Sutherland Asbill & Brennan LLP

(57) ABSTRACT

Embodiments of the invention relate to systems and methods for providing a removable sliding access door for an ice storage bin. In one embodiment, an access door is provided for use with a storage bin. The access door can include protrusions that engage corresponding recesses on tracks located adjacent to an access opening of the storage bin. The sliding access door can permit a user to access or view the contents of storage bin, and can be easily removed from the storage bin without the use of tools.

20 Claims, 3 Drawing Sheets

U.S. PATENT DOCUMENTS

| | | | | |
|---|---|---|---|---|
| 4,640,403 | A | | 2/1987 | McDermott |
| 4,706,553 | A | | 11/1987 | Sharp et al. |
| 4,767,286 | A | | 8/1988 | Kohl et al. |
| 4,768,683 | A | | 9/1988 | Gold et al. |
| 4,774,815 | A | | 10/1988 | Schlosser |
| 4,785,641 | A | | 11/1988 | McDougal |
| 4,788,830 | A | | 12/1988 | Schreiner et al. |
| 4,804,145 | A | | 2/1989 | Seymour et al. |
| 4,819,829 | A | * | 4/1989 | Rosten et al. ..... 220/345.3 |
| 4,845,955 | A | | 7/1989 | Taylor |
| 4,848,602 | A | | 7/1989 | Yoshimura et al. |
| 4,878,361 | A | | 11/1989 | Kohl et al. |
| 4,898,002 | A | | 2/1990 | Taylor |
| 4,907,422 | A | | 3/1990 | Kohl et al. |
| 4,913,315 | A | | 4/1990 | Wagner |
| 4,932,223 | A | | 6/1990 | Paul et al. |
| 4,944,654 | A | | 7/1990 | Chou et al. |
| 4,984,360 | A | | 1/1991 | Sather et al. |
| 4,986,088 | A | | 1/1991 | Nelson |
| 5,014,523 | A | | 5/1991 | Kohl |
| 5,025,945 | A | * | 6/1991 | Lyon ..... 220/740 |
| 5,060,484 | A | | 10/1991 | Bush et al. |
| 5,064,404 | A | | 11/1991 | Champion |
| 5,104,007 | A | | 4/1992 | Utter |
| 5,139,183 | A | | 8/1992 | Buchser et al. |
| 5,140,831 | A | | 8/1992 | Kohl et al. |
| 5,172,595 | A | | 12/1992 | Bush et al. |
| 5,193,357 | A | | 3/1993 | Kohl et al. |
| 5,245,841 | A | | 9/1993 | Paul et al. |
| 5,289,691 | A | | 3/1994 | Schlosser et al. |
| 5,408,834 | A | | 4/1995 | Schlosser et al. |
| 5,477,694 | A | | 12/1995 | Black et al. |
| 5,577,490 | A | | 11/1996 | Overton, Jr. |
| 5,586,439 | A | | 12/1996 | Schlosser et al. |
| 5,697,561 | A | | 12/1997 | Plank et al. |
| 5,704,224 | A | | 1/1998 | Choi |
| 5,752,393 | A | | 5/1998 | Schlosser et al. |
| 5,787,723 | A | | 8/1998 | Mueller et al. |
| 5,887,758 | A | | 3/1999 | Hawkes et al. |
| 5,953,925 | A | | 9/1999 | Mueller et al. |
| 5,979,689 | A | | 11/1999 | Lansky |
| 6,058,731 | A | | 5/2000 | Byczynski et al. |
| 6,134,907 | A | | 10/2000 | Mueller et al. |
| 6,148,621 | A | | 11/2000 | Byczynski et al. |
| D442,973 | S | | 5/2001 | Strandell et al. |
| 6,321,802 | B1 | | 11/2001 | Weeks et al. |
| D463,464 | S | | 9/2002 | Strandell et al. |
| 6,681,580 | B2 | | 1/2004 | Shedivy et al. |
| D486,687 | S | | 2/2004 | Strandell |
| 6,993,929 | B1 | | 2/2006 | Funk et al. |
| 2002/0020711 | A1 | | 2/2002 | Glass et al. |
| 2002/0073728 | A1 | | 6/2002 | Stensrud et al. |
| 2002/0078705 | A1 | | 6/2002 | Schlosser et al. |
| 2002/0115433 | A1 | | 8/2002 | Baker |
| 2003/0066306 | A1 | | 4/2003 | Renken et al. |
| 2003/0089120 | A1 | | 5/2003 | Kampert et al. |
| 2003/0126874 | A1 | | 7/2003 | Stensrud et al. |
| 2003/0126877 | A1 | | 7/2003 | Stensrud et al. |
| 2004/0035136 | A1 | | 2/2004 | Gist et al. |
| 2004/0069004 | A1 | | 4/2004 | Gist et al. |
| 2004/0134219 | A1 | | 7/2004 | Miller et al. |
| 2004/0187513 | A1 | | 9/2004 | Allison et al. |
| 2005/0005627 | A1 | | 1/2005 | Allison et al. |
| 2005/0056044 | A1 | | 3/2005 | Allison |
| 2005/0081545 | A1 | | 4/2005 | Gist et al. |
| 2005/0150250 | A1 | | 7/2005 | Allison et al. |
| 2005/0166612 | A1 | | 8/2005 | Allison et al. |
| 2006/0005565 | A1 | | 1/2006 | Roth et al. |
| 2006/0026985 | A1 | | 2/2006 | Hollen et al. |

FOREIGN PATENT DOCUMENTS

| | | | |
|---|---|---|---|
| CN | 1152105 | | 6/1997 |
| CN | 1412507 | | 4/2003 |
| CN | 2727658 | | 9/2005 |
| CN | 2727659 | | 9/2005 |
| EP | 1228336 | | 8/2002 |
| EP | 1293737 | A2 | 3/2003 |
| EP | 1347256 | A2 | 9/2003 |
| EP | 1510767 | A2 | 3/2005 |
| EP | 1510767 | A3 | 4/2005 |
| FR | 2785371 | A1 | 5/2000 |
| GB | 2304880 | A | 3/1997 |
| GR | 3029642 | | 6/1999 |
| JP | 60187990 | | 9/1985 |
| JP | 2033587 | | 2/1990 |
| JP | 06315929 | A2 | 11/1994 |
| JP | 10281603 | | 10/1998 |
| JP | 10300299 | | 11/1998 |
| JP | 11211297 | | 8/1999 |
| JP | 200213841 | A | 8/2000 |
| TW | 589443 | B | 6/2004 |
| WO | 00/75579 | A1 | 12/2000 |
| WO | 01/35037 | A1 | 5/2001 |
| WO | 02/23105 | A1 | 3/2002 |
| WO | 02/27249 | A3 | 4/2002 |
| WO | 02/065031 | A1 | 8/2002 |
| WO | 03/067164 | A2 | 8/2003 |
| WO | 03/067164 | A3 | 8/2003 |
| WO | 03/098131 | A1 | 11/2003 |
| WO | 2004/081466 | A2 | 9/2004 |
| WO | 2004/081466 | A3 | 9/2004 |
| WO | 2004/102087 | A2 | 11/2004 |
| WO | 2004/102087 | A3 | 11/2004 |
| WO | 2005/035430 | A2 | 4/2005 |
| WO | 2005/038362 | A1 | 4/2005 |
| WO | 2005/057100 | A2 | 6/2005 |
| WO | 2005/074562 | A2 | 8/2005 |

* cited by examiner

SYSTEMS AND METHODS FOR PROVIDING A REMOVABLE SLIDING ACCESS DOOR FOR AN ICE STORAGE BIN

RELATED APPLICATION

This application claims priority to U.S. Ser. No. 60/808,022, entitled "Systems and Methods for Providing a Removable Sliding Access Door for an Ice Storage Bin," filed May 24, 2006, the contents of which are hereby incorporated by reference.

FIELD OF THE INVENTION

The invention generally relates to ice making, and more particularly relates to systems and methods for providing a removable sliding access door for an ice storage bin.

BACKGROUND OF THE INVENTION

Ice has long been used for various commercial and domestic demands. In the domestic context, ice making machines and storage bins are typically located in a freezer portion of a refrigerator or in a free-standing freezer. These domestic ice machines and storage bins are typically designed to hold only a small amount of ice.

In the commercial context, there is typically a need for greater quantities of ice than in the domestic context. Some examples of commercial uses of ice include beverage and ice machines at restaurants, convenience stores, or hotels, but there are many other examples that require large quantities of ice. In the commercial context ice can be stored in generous quantities within a large bin, such as the bins described in U.S. Pat. Nos. 5,887,758 and 4,903,866. Large quantities of ice can be stored in such bins and there is typically an access opening to provide a user access to the ice.

A difficulty in storing large quantities of ice in a storage bin is the propensity of the ice to "bridge" over time, making it difficult to dispense the ice. That is, when ice is stored in a large bin, some of the ice might melt slightly and then re-freeze in clumps, also called bridges. For example, ice might melt if some inner surfaces of the bin are at a higher temperature than other inner surfaces of the bin. When the ice melts, liquid can form on the surface of the ice. In some instances, the liquid can re-freeze, causing the ice to re-freeze in clumps, thereby bridging. When ice bridges, the ice becomes more difficult to dispense from the storage bin.

Several types of access openings for ice storage bins are known in the art. For example, Japanese Patent Publication No. 10-238917 has a hinged door that swings outward from the storage bin and away from the ice stored inside the bin. On the other hand, some ice storage bins have hinged doors that swing inward towards the ice inside the bin. In many instances, tools may be required to remove or otherwise service such hinged doors, which can be inconvenient if the tools are not readily available.

In some instances, ice storage bins may have one or more windows to view the level of ice inside the bin. One problem with such windows is that the windows often fog up, which makes it difficult for a user to see inside the bin to view the level of ice.

Therefore, a need exists for systems and methods for access to an ice storage bin.

SUMMARY OF THE INVENTION

Some or all embodiments of the invention can address the needs described above. For example, some embodiments of the invention can provide a storage bin for ice or other small particles, such as animal feed, candies, or the like. By way of another example, other embodiments of the invention can provide an access door for a user to view, access, deposit, or remove contents from the storage bin. In addition, some embodiments of the invention can provide an access door for an ice storage bin that can be removed from the bin. For instance, the access door can slide on tracks to allow a user to monitor the level of ice within the bin. The access door can be removed without the need for special tools to provide for easy cleaning of the door away from the storage bin.

In one embodiment, an access door for a storage bin can slide on at least one track. The access door can include a series of keyed protrusions adjacent to an edge of the access door. The track can include a corresponding series of keyed recesses to receive some or all of the protrusions associated with the access door. When access to contents of a storage bin is desired, a user can slide the access door within the track. When needed, the access door can be removed from the track by aligning the series of keyed protrusions with the corresponding series of keyed recesses associated with the track. When the protrusions are aligned with the recesses, the access door can be manipulated towards the recess, thus permitting a lower portion of the access door to be rotated out of the track and removed.

One aspect of an embodiment of the invention is to provide an access door that can slide to permit a user access to the contents of a storage bin.

Another aspect of an embodiment of the invention is to provide an access door that can be removed without the use of tools.

A further aspect of an embodiment of the invention is to provide an access door for a storage bin that can be easily removed for cleaning the access door away from the storage bin.

One embodiment of the invention provides a method for providing a removable sliding access door for an ice storage bin. In this embodiment, the method can include providing a track adapted to receive a portion of an access door, wherein the track comprises at least one recess adapted to receive a protrusion associated with an access door. In addition, the method can include providing a second track adapted to receive another portion of the access door. Furthermore, the method can include providing an access door adapted to slide on at least the track, wherein the access door comprises at least one protrusion adjacent to an edge of the access door and the at least one protrusion is adapted to mount within at least one recess associated with the track. Moreover, the method can include sliding the access door within the track, wherein the at least one protrusion can be aligned with the at least one recess, and a portion of the access door can be removed from the second track to facilitate removal of the access door from the track.

In one aspect of this embodiment, the track and second track can each include at least one of the following: a square U-shaped profile, a L-shaped profile, or a T-shaped profile.

In yet another aspect of this embodiment, the at least one recess and the at least one protrusion can include a square-shaped recess and corresponding square-shaped protrusion.

In yet another aspect of this embodiment, the track can include a plurality of recesses, and the access door can include a plurality of protrusions.

In yet another aspect of this embodiment, the method can further include rotating the portion of the access door away from second track, and disengaging the at least one protrusion from contact with the at least one recess, wherein the access door can be removed from the track.

In another embodiment of the invention, a system for providing a removable sliding access door for an ice storage bin can be provided. The system can include a track associated with an access opening in an ice storage bin, wherein the track is adapted to receive a portion of an access door, and wherein the track comprises at least one recess adapted to receive a protrusion associated with an access door. Furthermore, the system can include a second track associated with an access opening in the ice storage bin, the second track adapted to receive another portion of the access door. Moreover, the system can include an access door adapted to slide on at least the track, wherein the access door comprises at least one protrusion adjacent to an edge of the access door and the at least one protrusion is adapted to mount within at least one recess associated with the track, wherein the at least one protrusion can be aligned with the at least one recess, and a portion of the access door can be removed from the second track to facilitate removal of the access door from the track.

In one aspect of this embodiment, the track and second track can each include at least one of the following: a square U-shaped profile, a L-shaped profile, or a T-shaped profile.

In another aspect of this embodiment, the at least one recess and the at least one protrusion can include a rectangular-shaped recess and corresponding rectangular-shaped protrusion.

In another aspect of this embodiment, the track can include a plurality of recesses, and the access door can include a plurality of protrusions.

In another aspect of this embodiment, the second track can include at least one recess, and the access door can include a corresponding protrusion adapted to mount within the at least one recess associated with the second track.

In another embodiment of the invention, a removable sliding access door for an ice storage bin can be provided, wherein the ice storage bin can include a track and a second track, wherein each track is adapted to receive a respective portion of the access door, and wherein the track can include at least one recess adapted to receive a protrusion associated with the access door. In this embodiment, the access door can include at least one edge adapted to slide within the track. Furthermore, the access door can include at least one protrusion adjacent to the edge of the access door, wherein the at least one protrusion is adapted to fit within at least one recess associated with the track, wherein the at least one protrusion can be aligned with the at least one recess, and a portion of the access door can be removed from the second track to facilitate removal of the access door from the track.

In one aspect of this embodiment, the at least one recess and the at least one protrusion can include a rectangular-shaped recess and corresponding rectangular-shaped protrusion.

In another aspect of this embodiment, the at least one protrusion can include a plurality of protrusions, and the track can include a plurality of recesses.

In another aspect of this embodiment, the access door can include another protrusion adjacent to another edge of the access door, wherein the other protrusion is adapted to mount within at least one recess associated with the second track.

In another aspect of this embodiment, the at least one edge is adapted to mount to the track with at least one of the following: a square U-shaped profile, a L-shaped profile, or a T-shaped profile.

In yet another embodiment of the invention, an ice storage bin with an access opening can be provided. In this embodiment, the ice storage bin can include a track mounted adjacent to the access opening and adapted to receive a portion of a slidable access door, wherein the track comprises a series of recesses adapted to receive a corresponding series of protrusions associated with an access door. In addition, the access door can include a second track mounted adjacent to the access opening and adapted to receive another portion of the slidable access door. Furthermore, in this embodiment, the corresponding series of protrusions can be aligned with the series of recesses, and at least a portion of the slidable access door can be removed from the second track to facilitate removal of the slidable access door from the track.

In one aspect of this embodiment, the track can include at least one of the following: a square U-shaped profile, a L-shaped profile, or a T-shaped profile.

In another aspect of this embodiment, the second track can include at least one of the following: a square U-shaped profile, a L-shaped profile, or a T-shaped profile.

In another aspect of this embodiment, the series of recesses can include rectangular-shaped recesses and the series of protrusions can include corresponding rectangular-shaped protrusions.

In another aspect of this embodiment, the second track can include a series of recesses adapted to receive another corresponding series of protrusions associated with the slidable access door.

Other embodiments and aspects of embodiments of the invention will become apparent from the following description taken in conjunction with the accompanying drawings.

BRIEF DESCRIPTION OF THE DRAWINGS

These and other aspects, features, and advantages of the present invention are better understood when the following Detailed Description is read with reference to the accompanying drawings, wherein.

DETAILED DESCRIPTION OF EMBODIMENTS

Figure 1:
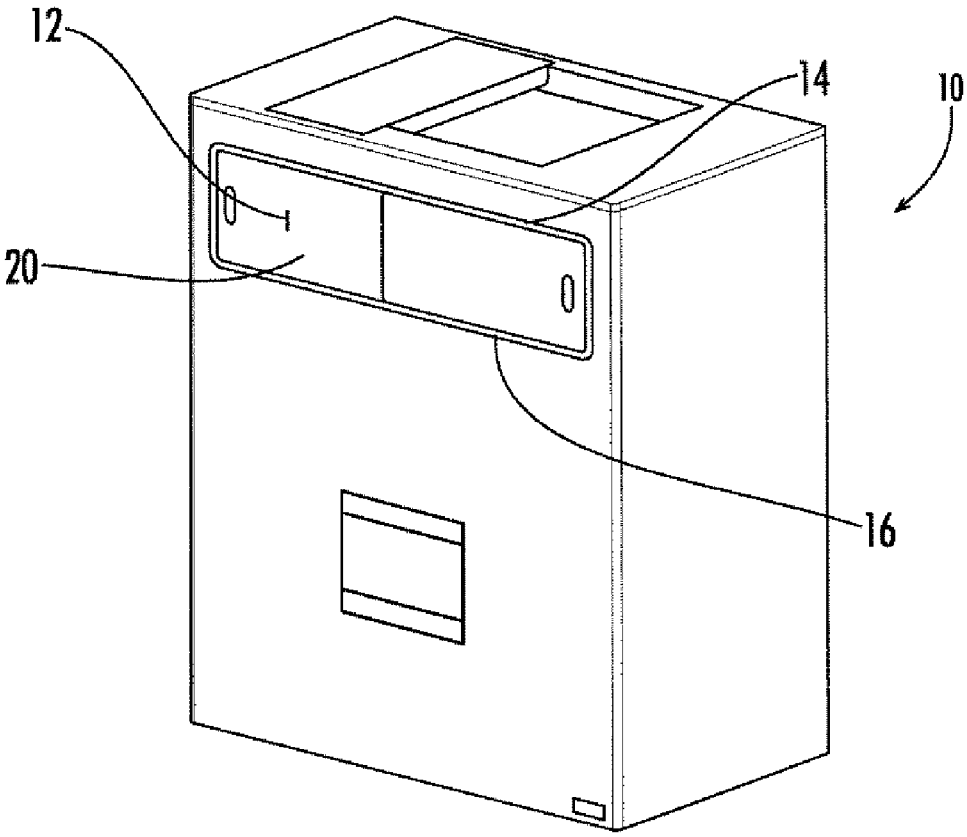
FIG. 1 shows an ice storage bin with a removable sliding access door in accordance with an embodiment of the invention.
Figure 2:
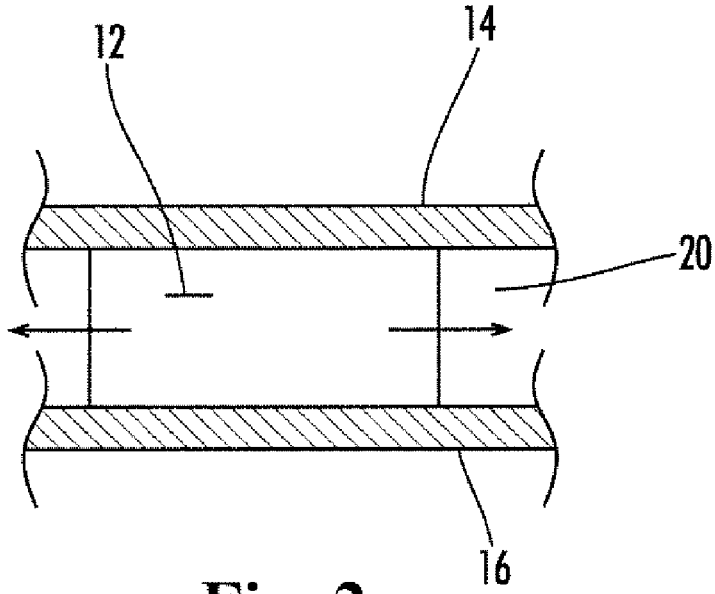
FIG. 2 shows a front view of a removable sliding access door, wherein the door is mounted on two horizontal tracks, in accordance with an embodiment of the invention.

With reference now to FIGS. 1 and 2, an embodiment of the invention is shown as an access door 10 for an ice storage bin. In the example shown in FIG. 1, the access door 12 mounts on two tracks 14 and 16 located adjacent to an access opening 20 of a storage bin 22. In the example shown, the tracks 14, 16 are respectively located in the upper portion and lower portion of the access opening 20. In other embodiments, the tracks can be located in other portions of the access opening 20, such as on opposing lateral sides or portions of the access opening 20.

The access opening 20 can be defined on any surface of the bin 22, including the front surface as shown. Alternatively, the access opening 20 could be defined on either of the side surfaces, the back surface, or the upper surface of the bin 22. The opening 20 can be any general shape, but a rectangular or square-shaped access opening 20 is suitable. In addition, the access opening 20 can be located at several different heights with respect to the bin 22. In the embodiment shown, the access opening 20 can be located slightly above that of the expected or typical height of the contents of the storage bin 22. For example, the access opening 20 can be located on the front surface of the bin 22 slightly above the expected or typical height of ice stored within the bin 22.

Figure 3:
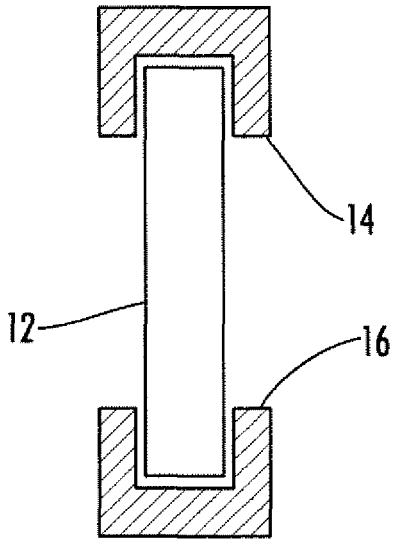
FIG. 3 shows a partial side view of the access door shown in FIG. 2 mounted on two horizontal tracks, in accordance with an embodiment of the invention.

Two tracks 14 and 16 are located adjacent to the edges of the access opening 20. The tracks 14 and 16 can be located on the horizontal or vertical edges of the access opening 20, but as shown the tracks 14, 16 can be respectively located adjacent to the upper and lower horizontal edges. The tracks 14 and 16 can be any suitable track capable of receiving a portion of an access door 12, and permitting sliding movement of the access door 12 with respect to the storage bin 22. In the embodiment shown in FIG. 3, the tracks 14 and 16 have a generally square "U"-shaped profile, and the upper portion and lower portion of the access door 12 can fit within a portion of the respective square "U"-shaped tracks 14, 16. Other types of tracks can be used, however, and the invention is not limited to the particular track configuration shown. For example, a track could have a "T"-shaped profile, wherein an extended portion associated with the track could fit into a corresponding channel adjacent to an edge of the access door. In another example, a track could have a "L"-shaped profile, wherein an underside portion of the access door can contact a vertically raised portion of the track. Also, the upper track 14 could be a different type or configuration than the lower track 16 depending on user selection, type or shape of access door, or desired functionality. Alternatively, an access door, such as 12, could be mounted to an access opening, such as 20, without the use of any tracks, such as 14 and 16, and the access door could be mounted using other types of mounting devices, such as hinges, swivels, or other connection-type devices, in accordance with embodiments of the invention.

Figure 6:
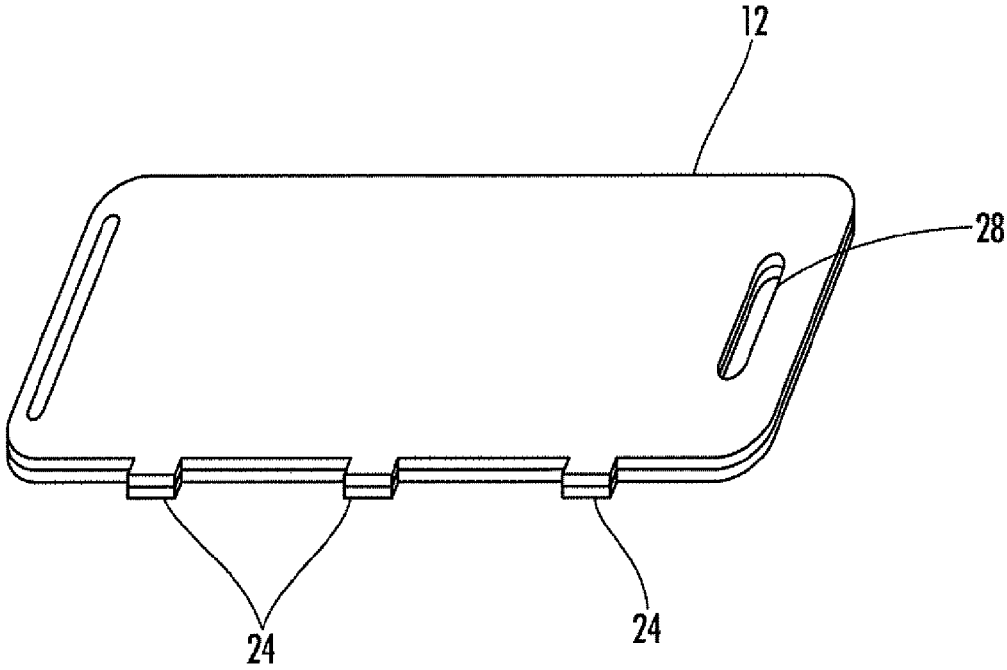
FIG. 6 shows an isometric view of another embodiment of an access door, detailing protrusions adjacent to an edge of the access door, in accordance with an embodiment of the invention.

When it is desired to access or view the contents within the storage bin 22, a user can slide the access door 12 within the tracks 14 and 16 to provide user access to the interior of the bin 22 through the access opening 20. As shown in the example of FIG. 2, the sliding movement is shown in either of the horizontal directions In other configurations, the sliding movement may be in a vertical direction or other directions depending on the position and configuration of the access door with respect to the tracks. As shown in FIG. 2, the access door 12 can slide back and forth in either of the horizontal directions. A user can slide the access door 12 by grasping a portion of the access door 12 and either pulling or pushing the access door 12 to either side in the horizontal direction. Alternatively, there may be a cut-out 28 (shown in FIG. 6), handle, or other device mounted to the access door 12 for a person to grasp and to slide the access door 12 to either side in either of the horizontal directions.

Figure 4:
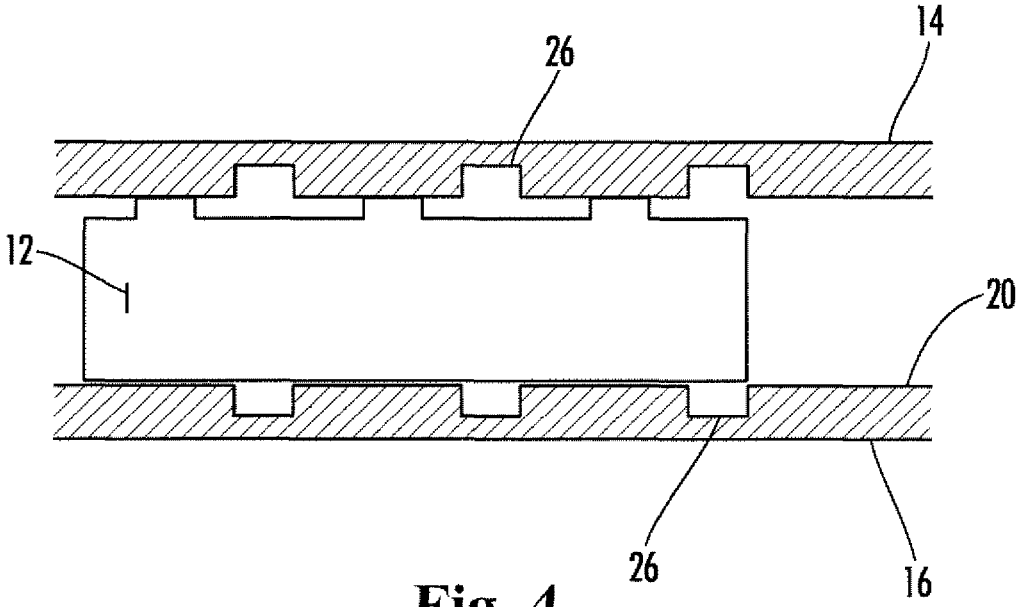
FIG. 4 shows a sectional front view of the access door of FIGS. 2-3, detailing the protrusions adjacent to an edge of the access door and the corresponding recesses associated with the track, in accordance with an embodiment of the invention.

FIG. 4 shows a sectional front view of the access door 12 shown in FIG. 2, wherein a portion of the tracks 14 and 16 has been cut away to view details associated with the access door 12 and tracks 14, 16. As shown, the access door 12 can include a number of protrusions 24 along the upper edge of the access door 12, and a plurality of corresponding recesses 26 along both the upper track 14 and/or the lower track 16. The embodiment shown in FIG. 4 shows a plurality of protrusions 24 and a plurality of corresponding recesses 26. In another embodiment, an access door such as 12 may only have one protrusion 24 and an associated track may only have one corresponding recess 26. Other embodiments may have any number of protrusions and corresponding recesses. In this embodiment the access door 12 can be positioned with the protrusions 24 adjacent to either the upper track 14 or the lower track 16. In another embodiment, only one of the upper or lower tracks may have recesses, such as 26. In such an embodiment, the access door, for example 12, could be positioned with the protrusions, such as 24, adjacent to the appropriate track that includes recesses, such as 26.

Figure 5:
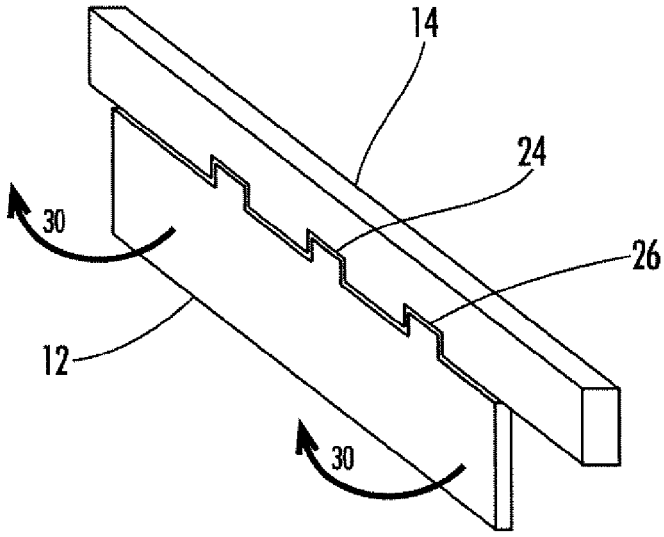
FIG. 5 shows an isometric view of the access door of FIGS. 2-4, wherein the protrusions adjacent to an edge of the access door are aligned with the recesses associated with the track, in accordance with an embodiment of the invention.

When a user desires to remove the access door 12 from the storage bin 22, the protrusions 24 associated with the access door 12 can be aligned with the corresponding recesses 26 associated with the tracks 14 or 16. In this manner, the access door 12 can be moved so that the protrusions 24 are engaged with or are otherwise aligned with the corresponding recess 26 as shown in FIG. 5, or if only one protrusion and recess exist, so that the protrusion is engaged with or is otherwise aligned with the corresponding recess. Accordingly, the upper edge of the access door 12 can be manipulated further upward within the upper track 14, and the lower edge of the access door 12 can be moved above the edge of the lower track 16 such that the lower portion of the access door 12 can be rotated away (as shown by arrows 30 in FIG. 5) from the lower track 16 until the lower edge of the access door 12 clears the lower track 16. The upper edge of the access door 12 can then be removed from the upper track 14, and the access door 12 can be removed completely from the bin 22. With the access door 12 removed from the storage bin 22, the access door 12 can be cleaned, repaired, or otherwise worked on separately from the storage bin 22. In addition, the upper track 14, lower track 16, and their respective recesses 26 can be cleaned, repaired, or otherwise worked on separately from the access door 12.

When a user desires to install the access door 12 with respect to the storage bin 22, the protrusions 24 of the upper edge of the access door 12 can be aligned and engaged with the corresponding recesses 26 in the upper track 14. Likewise, if only one protrusion and corresponding recess exist, then the protrusion is aligned and engaged with the corresponding recess. In any instance, the lower edge of the access door 12 can be rotated so that the lower edge is positioned within the bottom track 16 and then the lower edge of the access door 12 can be lowered within the lower track 16. In this manner, the access door 12 moves slightly downward from the upper track 14 causing the protrusions 24 to remain aligned with the corresponding recesses 26 and maintaining the upper edge of the access door 12 within the upper track 14. The access door 12 can be moved in a horizontal direction as shown in FIG. 2, and the protrusions 24 and recesses 26 will become unaligned while permitting the access door to slide with respect to the upper track 14 and lower track 16.

One skilled in the art will recognize other configurations, shapes, and designs can exist in accordance with other embodiments of the invention. It will be recognized by those skilled in the art that changes may be made in the above described embodiments of the invention without departing from the concepts thereof. The invention is not limited to the particular embodiments disclosed, but is intended to cover all modifications that are within the scope of the invention.

The claimed invention is:

1. A method for providing a removable sliding access door for an ice storage bin, the method comprising:

providing an upper track adapted to receive an upper edge of an access door, wherein the upper track comprises at least one recess adapted to receive a protrusion associated with the access door;

providing a lower opposing track adapted to receive another edge of the access door, wherein alignment of the upper track and the lower opposing track defines an access opening plane;

providing the access door adapted to slide on the upper track and the lower track, wherein the access door comprises the protrusion perpendicular to the upper edge of the access door and the protrusion is adapted to mount within at least one recess associated with the upper track; and sliding the access door perpendicular to the upper track while the upper edge of the access door is maintained within the upper track, wherein the protrusion is aligned and engaged with the at least one recess, and wherein the access door is removed from the lower track to facilitate removal of the access door from the upper track.

2. The method of claim 1, wherein the first track and second opposing track each comprise at least one of the following: a square U-shaped profile, a L-shaped profile, or a T-shaped profile.

3. The method of claim 1, wherein the at least one recess and the protrusion comprise a square-shaped recess and corresponding square-shaped protrusion.

4. The method of claim 1, wherein the first track comprises a plurality of recesses, and the access door comprises a plurality of protrusions.

5. The method of claim 1, further comprising:

rotating the portion of the access door away from second opposing track; and disengaging the protrusion from contact with the at least one recess, wherein the access door can be removed from the first track.

6. A system for providing a removable sliding access door for an ice storage bin, the system comprising:

a first track associated with an access opening in an ice storage bin, the first track adapted to receive a portion of an access door, wherein the first track comprises at least one recess adapted to receive a protrusion associated with the access door;

a second track associated with an access opening in the ice storage bin, the second track adapted to receive another portion of the access door, wherein alignment of the first track and the second track defines an access opening plane;

the access door adapted to slide on at least the first track and second track, wherein the access door comprises the protrusion perpendicular to an upper edge of the access door and the protrusion is adapted to mount within the at least one recess associated with the first track, and when the protrusion is aligned with the at least one recess, and the access door is manipulated perpendicular to the first track to engage the protrusion with the at least one recess while the upper edge of the access door is maintained within the first track, wherein the access door can be removed from the second track to facilitate removal of the access door from the first track.

7. The system of claim 6, wherein the track and second track each comprise at least one of the following: a square U-shaped profile, a L-shaped profile, or a T-shaped profile.

8. The system of claim 6, wherein the at least one recess and the protrusion comprise a rectangular-shaped recess and corresponding rectangular-shaped protrusion.

9. The system of claim 6, wherein the track comprises a plurality of recesses, and the access door comprises a plurality of protrusions.

10. The system of claim 6, wherein the second track comprises at least one recess, and the access door comprises a corresponding protrusion adapted to mount within the at least one recess associated with the second track.

11. A removable sliding access door for an ice storage bin, wherein the ice storage bin comprises a first track and a second track, wherein alignment of the first track and the second track defines an access opening plane, each track adapted to receive a respective portion of the access door, and wherein the first track comprises at least one recess adapted to receive at least one protrusion associated with the access door, the access door comprising:

at least one edge adapted to slide within the first track; and the at least one protrusion perpendicular to the edge of the access door, wherein the at least one protrusion is adapted to fit within the at least one recess associated with the first track, and when the at least one protrusion is aligned with the at least one recess, and the access door is manipulated perpendicular to the first track to engage the at least one protrusion with the at least one recess while the at least one edge of the access door is maintained within the first track, wherein the access door can be removed from the second track to facilitate removal of the access door from the first track.

12. The removable sliding access door of claim 11, wherein the at least one recess and the at least one protrusion comprise a rectangular-shaped recess and corresponding rectangular-shaped protrusion.

13. The removable sliding access door of claim 11, wherein the at least one protrusion comprises a plurality of protrusions, and the track comprises a plurality of recesses.

14. The removable sliding access door of claim 11, further comprising another protrusion adjacent to another edge of the access door, wherein the other protrusion is adapted to mount within at least one recess associated with the second track.

15. The removable sliding access door of claim 11, wherein the at least one edge is adapted to mount to the track with at least one of the following: a square U-shaped profile, a L-shaped profile, or a T-shaped profile.

16. An ice storage bin with an access opening, the ice storage bin comprising:

a first track mounted adjacent to the access opening and adapted to receive a portion of a slidable access door, wherein the first track comprises a series of recesses adapted to receive a corresponding series of protrusions associated with the slidable access door and perpendicular to an upper edge of the slidable access door; and a second track mounted adjacent to the access opening and adapted to receive another portion of the slidable access door, wherein alignment of the first track and the second track defines an access opening plane;

wherein when the corresponding series of protrusions are aligned with the series of recesses, and the slidable access door is manipulated perpendicular to the first track to engage the corresponding series of protrusions with the series of recesses while maintaining the upper edge of the slidable access door within the first track, wherein the slidable access door can be removed from the second track to facilitate removal of the slidable access door from the first track.

17. The ice storage bin of claim 16, wherein the track comprises at least one of the following: a square U-shaped profile, a L-shaped profile, or a T-shaped profile.

18. The ice storage bin of claim 16, wherein the second track comprises at least one of the following: a square U-shaped profile, a L-shaped profile, or a T-shaped profile.

19. The ice storage bin of claim 16, wherein the series of recesses comprise rectangular-shaped recesses and the series of protrusions comprise corresponding rectangular-shaped protrusions.

20. The ice storage bin of claim 16, wherein the second track comprises a series of recesses adapted to receive another corresponding series of protrusions associated with the slidable access door.

* * * * *